US005241354A

United States Patent [19]

Flynn

[11] Patent Number: 5,241,354

[45] Date of Patent: Aug. 31, 1993

[54] SYMMETRICALLY FLEXIBLE SHEET STRIPPING APPARATUS

[75] Inventor: Michael R. Flynn, Rochester, N.Y.

[73] Assignee: Eastman Kodak Company, Rochester, N.Y.

[21] Appl. No.: 868,157

[22] Filed: Apr. 14, 1992

[51] Int. Cl.[5] ..... G03G 21/00

[52] U.S. Cl. ..... 355/315; 355/282; 271/311; 271/900; 271/313

[58] Field of Search ..... 355/315, 282, 289, 290; 271/307, 308, 311, 312, 313, 900; 219/216

[56] References Cited

U.S. PATENT DOCUMENTS 4,119,307 10/1978 Hamaker ..... 271/900
4,119,308 10/1978 Hamaker ..... 271/900
4,269,594 5/1981 Umans et al. ..... 432/59
4,332,457 6/1982 Mitsuyama et al. .
4,355,881 10/1982 Tarumi et al. .
4,375,327 3/1983 Matsumoto et al. .
4,408,861 10/1983 Hukuda et al. ..... 355/315
4,739,362 4/1988 Kau et al. .
4,821,064 4/1989 Mills et al. ..... 355/315
4,870,464 9/1989 Itaya et al. ..... 355/282
4,914,484 4/1990 Kida ..... 355/290
4,937,631 6/1990 Kim et al. ..... 355/290
4,949,131 8/1990 Ito ..... 355/282

*Primary Examiner*—R. L. Moses
*Attorney, Agent, or Firm*—J. Gary Mohr

[57] ABSTRACT

A symmetrically flexible separator device is placed immediately after and removed, by a pair of pads, from the nip between the fuser roller and the pressure roller in order to intercept the leading edge of an image-bearing receiver and thus reduce the risk that the latter would remain stuck to the surface of either the fuser roller or the pressure roller.

7 Claims, 3 Drawing Sheets

SYMMETRICALLY FLEXIBLE SHEET STRIPPING APPARATUS

BACKGROUND OF THE INVENTION

1. Field of the Invention

This invention relates to a reproduction apparatus, and more particularly to a separating device for removing a sheet from a fusing station contained within the reproduction apparatus.

2. Description of the Prior Art

Generally, in an image formation process using a recording device, for instance an electrophotographic copying machine, a visible image is formed by forming an electrostatic latent image, corresponding to a document image, with a corona charge and a light irradiation on a photosensitive member, and developing it with a toner developer containing fine thermoplastic powders. The visible image or toner image thus formed on the photosensitive member is transferred to a receiver material such as paper. The toner image is then fused, on the paper, by a conventional heat roller fusing means.

The problem with the above system is that even with rollers that have fairly good release surfaces, the paper may still wrap around a roller.

Attempts to correct the wrap-around problem have been disclosed in U.S. Patents:

No. 4,375,327, which provides a two claw system to remove the copy sheet from the rollers. However, tight controls are needed regarding the angle between the rollers and the claws to prevent damage to the fusing area of the rollers;

No. 4,870,464, which provides a separation pawl in contact with the fusing section of the rollers, this, however, creates a potential for damage to the fusing section of the rollers;

No. 4,332,457, which provides a stripping member pressed against the rollers when the copy sheet makes contact with the rollers, but again since there is contact with the fusing section of the rollers, there is a potential for damage to that section of said rollers; and No. 4,269,594, which provides a pair of sheet deflectors for intercepting and deflecting an image support clinging to either the fuser or pressure roller. It does not, however, provide for symmetrical flexure of the sheet deflectors which is important when it is not known to which roller the sheet may stick. In addition, there isn't any contact between the deflectors and the rollers, thereby making control of the spacing between the sheet deflectors and the rollers difficult to maintain.

In addition to the potential for damage to the rollers whenever contact is made and the criticality of the spacing between the separators and the rollers, contact has a tendency to pick off toner from the rollers and deposit it in undesirable spots on the receiver.

What is needed is a reliable separating device that will not damage the rollers in the area where fusing takes place yet still separate the receiver from the rollers and not be a source of toner pick up that may later be deposited in undesirable spots on the receiver.

SUMMARY OF THE INVENTION

It is an object of the present invention to prevent receiver wrap around at the fusing station without risk of damage to the fusing portion of the fusing station.

It is a further object of the invention to prevent toner pick up that may later be deposited in undesirable spots on the receiver.

The above objects are accomplished by a separating device installable in a reproduction apparatus of the type having a fusing nip, formed by cooperating members, for fusing a receiver, the separating device comprising:

symmetrically flexible engagement means for engaging and separating the receiver from the cooperating members;

the engagement means having a portion defining a slot for allowing the receiver to travel through the engagement means;

contact means for contacting the cooperating members and maintaining the engagement means removed from the cooperating members;

means for maintaining the contact means in contact with the cooperating members; and means for mounting the engagement means within the reproduction apparatus.

These and other advantages of the present invention will be apparent from the following description and the accompanying drawings.

DESCRIPTION OF THE PREFERRED EMBODIMENT

Figure 1:
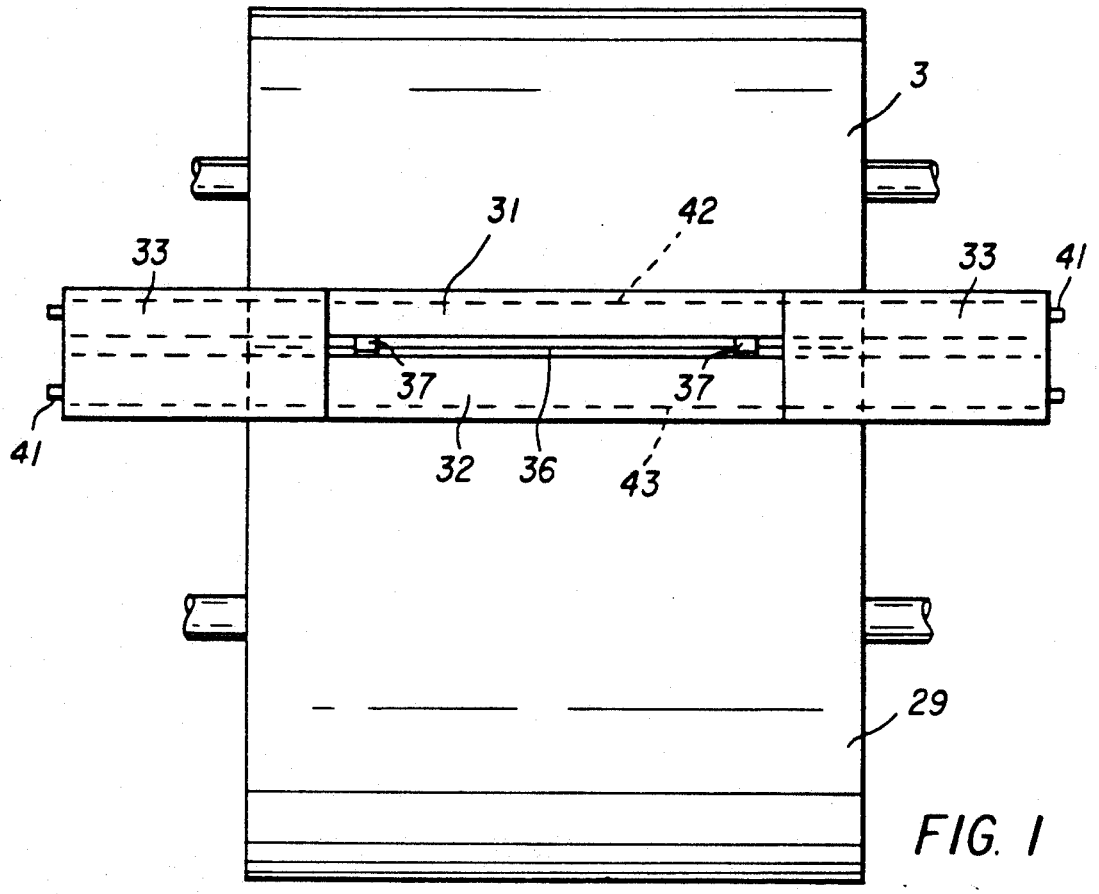
FIG. 1 is a schematic rear view of the sheet separating apparatus in accordance with the present invention, but with parts removed for clarity.

While the present invention is susceptible to embodiments of many different forms, there is shown in the drawings and hereinafter described in detail, a preferred embodiment of the invention. It should be understood, however, that the present disclosure is to be considered as an exemplification of the principles of the invention and is not intended to limit the invention to the embodiments illustrated and/or described.

For ease of description, the mechanism will be described in its normal operational position, and terms such as upper, lower, horizontal, etc. . . . , will be used with reference to normal operating positions. It will be understood, however, that this mechanism may be manufactured, stored, transported and sold in an orientation other than the normal operational positions described.

In describing the preferred embodiment of the present invention, reference is made to the drawings, wherein like numerals indicate like parts and structural features in the various views, diagrams and drawings.

Figure 2:
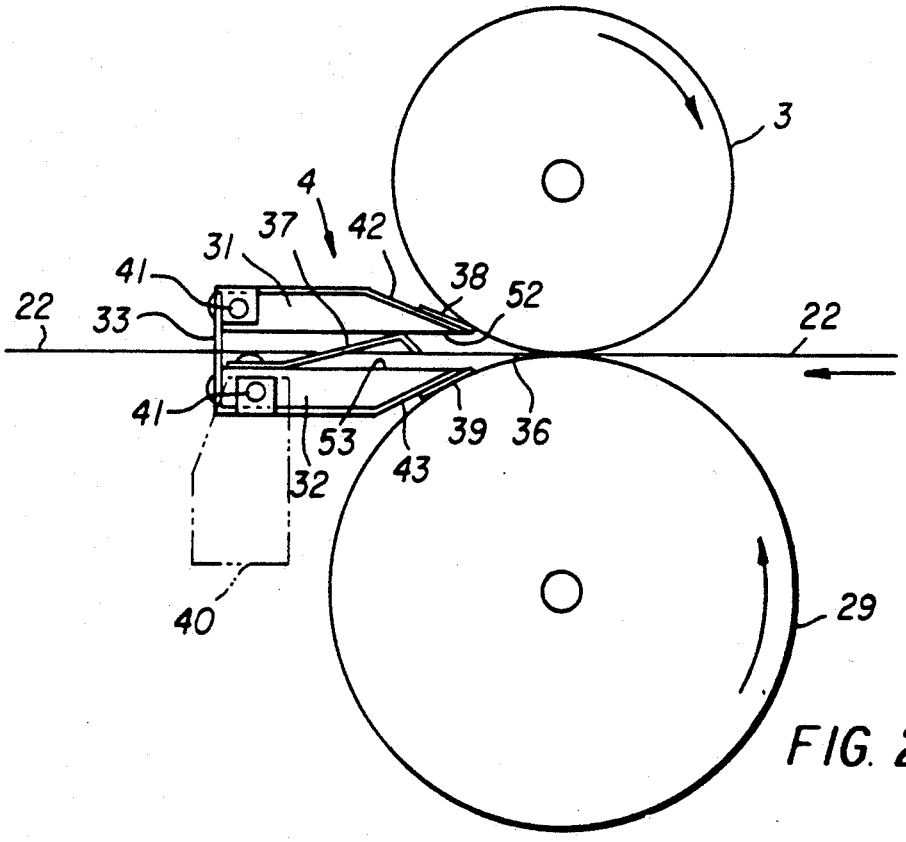
FIG. 2 is a schematic side view of the sheet separating apparatus in accordance with the present invention.
Figure 4:
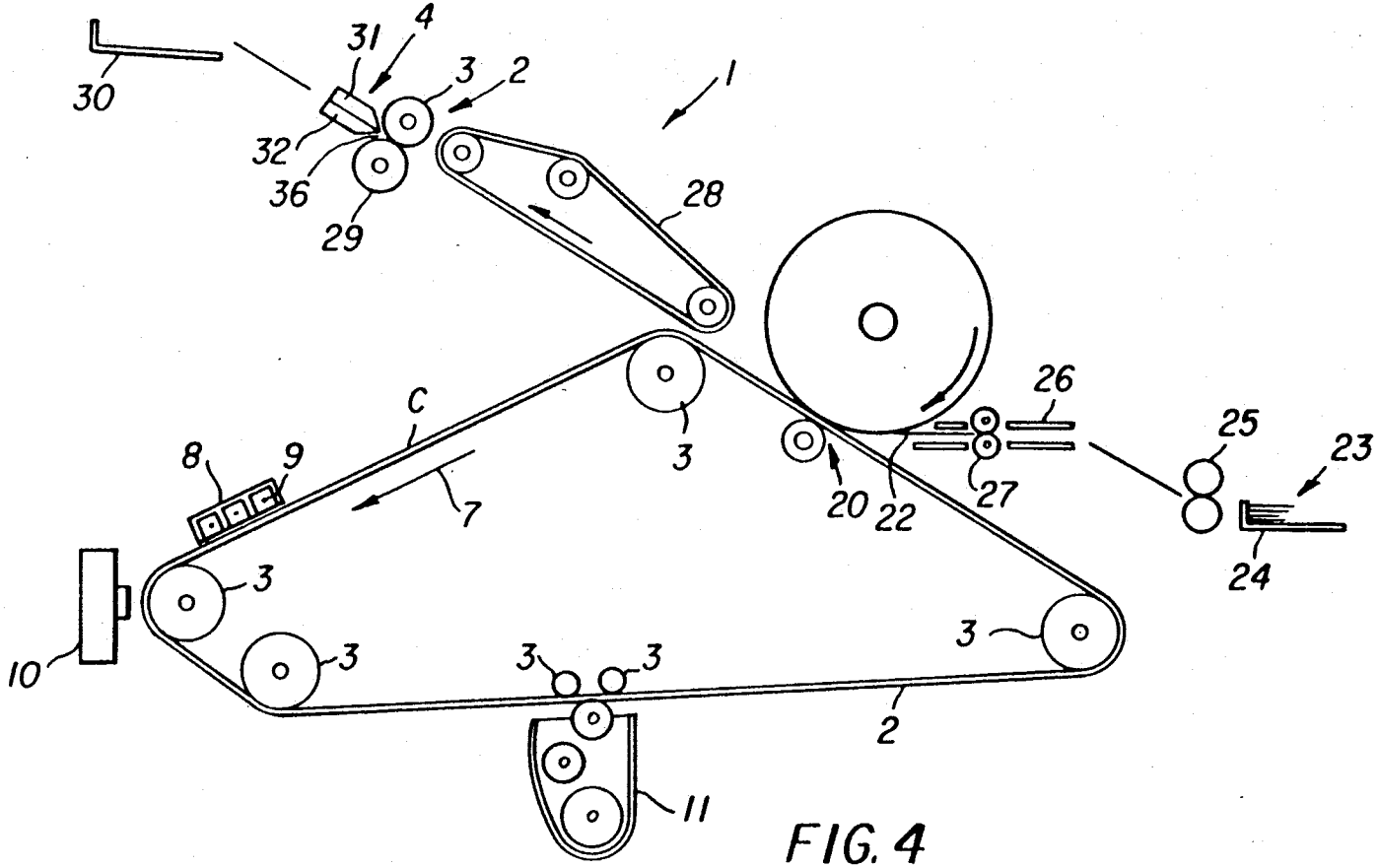
FIG. 4 (prior art)
FIG. 4 is a schematic side view of a prior art copier showing the location of the sheet separating apparatus of the present invention.

The environment of a separator device 4, see FIG. 2, which is the subject matter of the present invention, is a reproduction apparatus 1, see FIG. 4, such as an electrophotographic copying machine. Briefly, such an electrophotographic copying machine 1 has an electrophotographic belt 2 entrained about a series of rollers 3. As belt 2 rotates, in the direction of arrow 7, it moves adjacent to the various processing stations disposed around the periphery of belt 2.

During the initial rotation of belt 2, a portion of the photoconductive surface 6 of belt 2 moves adjacent to a charging apparatus 8 which includes a corona generating device 9 that imparts a uniform electrostatic charge to the photoconductor surface 6 of belt 2. After said electrostatic charge is imparted, an image, of a document to be copied, is transmitted to photoconductor surface 6 by exposure at imaging station 10.

As belt 2 continues to rotate, the image on photoconductive surface 6 is carried past a developer station 11, where toner particles are applied to the image on photoconductive surface 6 to develop the image electrostatically.

As belt 2 further rotates, the toner image moves adjacent a transfer station 20. At the same time the toner image arrives at transfer station 20, a receiver 22, such as a paper sheet, from a supply of sheets 23, stored in a tray 24, also arrives at transfer station 20. Receiver 22 is fed to transfer station 20 by a feed roller 25 which urges receiver 22 through a guide 26 and into the nip of queuing rollers 27. To assure that the toner image and receiver 22 arrive at transfer station 20 at the same time, at a predetermined time in the course of a copy cycle, the queuing rollers 27 are actuated to feed receiver 22 along guide 26 and into contact with the developed image carried by photoconductive surface 6 of belt 2.

Within transfer station 20, the toner particles are attracted from photoconductive surface 6, toward receiver 22, to which they loosely adhere. After transferring the toner particles to receiver 22, receiver 22 is stripped away from belt 2, by a suitable apparatus, and advanced, by belt conveyor 28, to a fusing station 2.

As receiver 22 passes through fusing station 2, which includes a fuser roller 3, the toner particles, now residing on receiver 22, are heated and fused to receiver 22, by the interaction of fuser roller 3 and pressure roller 29, thereby forming a permanent copy of the original document on receiver 22. After the toner image is permanently affixed to receiver 22, receiver 22 is then separated from fuser station 2 whereupon it is advanced to a catch tray 30 for subsequent removal, from copier 1, by an operator.

In the present invention, referring now to the drawings, and initially to FIGS. 2 and 4, separating device 4, is mounted adjacent the exit of a fusing nip 36 formed by cooperating members, such as fuser roller 3 and pressure roller 29.

Figure 3:
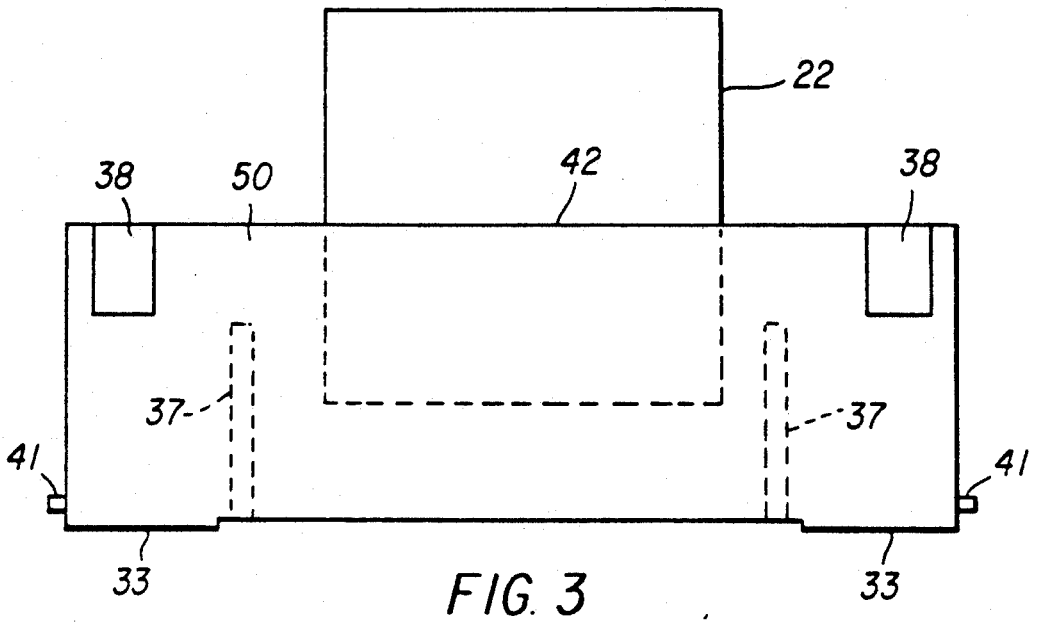
FIG. 3 is a schematic top view of the sheet separating apparatus in accordance with the present invention.
Figure 5:
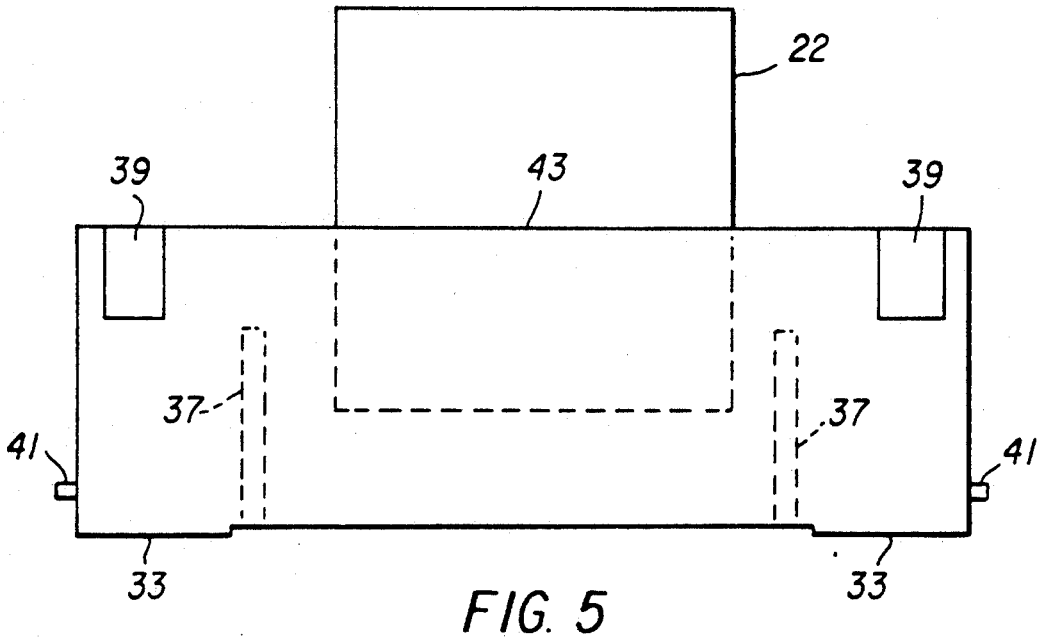
FIG. 5 is a schematic bottom view of the sheet separating apparatus in accordance with the present invention.

Separating device 4 has an upper separator member 31 and a lower separator member 32. Mounted on a front tapered edge 42 of upper separator member 31, are fuser contact pads 38, see FIG. 3, and mounted to a front tapered edge 43, of lower separator member 32, are pressure contact pads 39, see FIG. 5. Upper separator member 31 and lower separator member 32 are secured, to each other, in cantilever fashion, at their non-tapered ends, by mounting plates 33 as shown in FIGS. 1 and 2. This cantilever securing maintains internal surfaces 52 and 53, see FIG. 2, of separator members 31 and 32, sufficiently apart to allow receiver 22 to pass through separator device 4 and also provides flexibility to front tapered edges 42 and 43 so that springs 37, see FIGS. 2, 3 and 5, are able to bias front tapered edges 42 and 43 symmetrically apart. This type of biasing assures that separator device 4, when inserted into copier 1, will maintain the same force between fuser roller 3 and fuser contact pads 38 as it maintains between pressure roller 29 and pressure contact pads 39. This is critical, since receiver 22 may stick to either fuser roller 3 or pressure roller 29 and, therefore, it is important that the same efficiency of separation be maintained for fuser roller 3 as is maintained for pressure roller 29. Since spacing between fuser roller 3 and front edge 42 and pressure roller 29 and front edge 43 is also critical to separating receiver 22 from either fuser roller 3 or pressure roller 29, that spacing is accurately controlled by the thickness of pads 38 and 39 as pads 38 and 39 are biased between their respective mounting separator members and their respective contact rollers.

Attached to separating device 4 are pins 41 for mounting separating device 4 to a bracket 40, see FIG. 2, which is part of the mechanical structure, not shown, but known in the art, of copier 1. Pins 41 are located such that when they are inserted into mounting bracket 40, separating device 4 is positioned, adjacent nip 36, with fuser pads 38 contacting fuser roller 3 and pressure pads 39 contacting pressure roller 29, to provide, the heretofore discussed, spacing for front edge 42 to contact receiver 22, if receiver 22 tends to stick to fuser roller 3, and for front edge 43 to contact receiver 22, if receiver 22 tends to stick to pressure roller 29, as receiver 22 exits fusing nip 36.

As shown in FIGS. 3 and 5, both pads 38 and 39 and springs 37 are located near the outer edges of separators 31 and 32. Springs 37 being located between internal surfaces 52 and 53, as shown in FIG. 2, to provide, the heretofore discussed, symmetrical biasing, of separator members 31 and 32, but removed from contact with either fuser roller 3 or pressure roller 29. Pads 38 and 39, on the other hand, are mounted to top surfaces 50 and 51, see FIGS. 3 and 5, of upper separator member 31 and lower separator member 32 respectively, with the thickness of fuser contact pads 38 and pressure contact pads 39, as heretofore discussed, assuring a predetermined separation, preferably 0.015 inches, between both fuser roller 3 and front edge 42 of separator member 31 and pressure roller 29 and front edge 43, of separator member 32. Notwithstanding the fact that fuser contact pads 38 contact fuser roller 3 and pressure contact pads contact pressure roller 29, pads 38 and 39 are positioned outside the portion of fuser nip 36 where fusing takes place and therefore the chance that pads 38 and 39 will pick off toner from fuser roller 3 or pressure roller 29 and deposit it in an undesirable area of receiver 22 is remote. In addition, since pads 38 and 39 are of a smooth stainless steel composition their contact with fuser roller 3 and pressure roller 29 is not likely to damage either pressure roller 29 or fuser roller 3. However, even if the contact does damage fuser roller 3 or pressure roller 29 the damage caused, due to the location of pads 38 and 39 outside the fusing area of nip 36, will have no adverse effect on fusing quality.

As previously discussed, pads 38 and 39 maintain front edges 42 and 43 of separator members 31 and 32 a distance of 0.015 inches from fuser roller 3 and pressure roller 29. This distance is greater than the average thickness of receiver 22 used in copier 1, however, front edge 42 or 43 still makes contact with the lead edge of receiver 22 as it exits nip 36, since the average reproduction apparatus leaves approximately ¼ inch of the lead edge of a receiver un-toned. This un-toned portion of receiver 22 is not likely to stick to either fuser roller 3 or pressure roller 29 and remains at least ¼ inch removed from the surface of either fuser roller 3 or pressure roller 29. Therefore, with front edges 42 and 43 only 0.015 inches from the surface of fuser roller 3 and pressure roller 29, either front edge 42 or 43, by necessity, will engage the leading ¼ inch of receiver 22 and urge said leading edge between internal surfaces 52 and 53, as receiver 22 is stripped from either fuser roller 3 or pressure roller 29.

In operation, as receiver 22 begins to exit nip 36, the lead un-toned ¼ inch of receiver 22 engages either front edge 42 or 43 of separator 31 or 32. This engagement prevents the leading edge of receiver 22 from further rotational travel with either fuser roller 3 or pressure roller 29 and urges receiver 22 between internal surfaces 52 and 53. The rotational motion of fuser roller 3 or pressure roller 29, then, coupled with the preventing of further rotational travel by the lead edge of receiver 22, peels the remainder of receiver 22 from fuser roller 3 or pressure roller 29 and continues to urge receiver 22 between internal surfaces 52 and 53 until receiver 22 is completely free of fuser roller 3 or pressure roller 29. When receiver 22 is completely free of fuser roller 3 and pressure roller 29, receiver 22 is deposited into catch tray 30 for removal by an operator.

While only certain embodiments of the present invention have been described, it will be apparent to those skilled in the art that various changes and modifications may be made therein without departing from the spirit and scope of the invention as claimed.

What is claimed is:

1. A separating device installable in a reproduction apparatus of the type having a fusing nip, formed by cooperating members, for fusing a receiver traveling through the nip formed by the cooperating members, the separating device comprising:

symmetrically flexible engagement means mounted in a stationary position symmetrically between the cooperating members for engaging and separating the receiver from either of the cooperating members;

the engagement means having a portion defining a slot for allowing the receiver to travel through the engagement means;

contact means located outside the path of the receiver travel for contacting only a portion of the cooperating members and maintaining the engagement means removed from the cooperating members by a distance greater than the thickness of the receiver;

means for maintaining the contact means in contact with the cooperating members; and means for mounting the engagement means within the reproduction apparatus.

2. The separating device of claim 1 wherein the symmetrically flexible engagement means includes two flexible separator members secured to each other in cantilever fashion and biased apart.

3. The separating device of claim 2 wherein the contact means are pads located on the separator members for maintaining the separator members removed from the cooperating members by the thickness of the pads.

4. The separating device of claim 3 wherein the pads are located outside the receiver fusing nip.

5. The separating device of claim 3 wherein the means for maintaining the contact means in contact with the cooperating members are springs secured to one of the separator members and in contact with the other separator member for urging a front portion of the separator members symmetrically apart in opposition to the contact of the contact pads with the cooperating members.

6. An electrophotographic copying machine having a fusing nip formed by cooperating members for fusing a receiver traveling through the nip formed by the cooperating members and a separating device for removing the receiver from said cooperating members, said separating device comprising:

symmetrically flexible engagement means mounted in a stationary position symmetrically between the cooperating members for engaging and separating the receive from either of the cooperating members;

the engagement means having a portion defining a slot for allowing the receiver to travel through the engagement means;

contact means located outside the path of the receiver travel for contacting only a portion of the cooperating members and maintaining the engagement means removed from the cooperating members by a distance greater than the thickness of the receiver;

means for maintaining the contact means in contact with the cooperating members; and means for mounting the engagement means within the reproduction apparatus.

7. A separating device installable in a reproduction apparatus of the type having a fusing nip, formed by rollers, for fusing a receiver traveling through the nip formed by the rollers, the separating device comprising:

symmetrically flexible engagement means mounted in a stationary position symmetrically between the rollers for engaging and separating the receiver from either of the rollers;

the engagement means having a portion defining a slot for allowing the receiver to travel through the engagement means;

contact means located outside the path of the receiver travel for contacting only a portion of the rollers and maintaining the engagement means removed from the rollers by a distance greater than the thickness of the receiver;

means for maintaining the contact means in contact with the rollers; and means for mounting the engagement means within the reproduction apparatus.

* * * * *